US007739845B2

(12) United States Patent
Kennedy

(10) Patent No.: US 7,739,845 B2
(45) Date of Patent: Jun. 22, 2010

(54) INSULATED BUILDING BLOCK

(76) Inventor: Francis Kennedy, 4540 Gentwood Dr., Williamsville, NY (US) 14221

( * ) Notice: Subject to any disclaimer, the term of this patent is extended or adjusted under 35 U.S.C. 154(b) by 330 days.

(21) Appl. No.: 11/729,340

(22) Filed: Mar. 28, 2007

(65) Prior Publication Data

US 2008/0236081 A1 Oct. 2, 2008

(51) Int. Cl.
*E04B 1/74* (2006.01)
*E04B 1/02* (2006.01)
*E04C 1/00* (2006.01)

(52) U.S. Cl. ..... 52/405.3; 52/309.12; 52/570

(58) Field of Classification Search ..... 52/405, 52/405.1, 405.3, 570, 309.12, 503, 505, 404.1, 52/405.2, 406.2, 406.3, 407.2
See application file for complete search history.

(56) References Cited

U.S. PATENT DOCUMENTS 2,933,146 A * 4/1960 Zaldastani et al. ..... 52/144
3,204,381 A * 9/1965 Perreton ..... 52/309.12
3,546,833 A * 12/1970 Perreton ..... 52/314
3,632,725 A * 1/1972 Jones ..... 264/256
4,004,385 A * 1/1977 Kosuge ..... 52/259
4,027,445 A * 6/1977 Nickerson ..... 52/405.1
4,123,881 A * 11/1978 Muse ..... 52/100
4,134,241 A * 1/1979 Walton ..... 52/275
4,148,166 A * 4/1979 Toone ..... 52/309.12
4,185,434 A 1/1980 Jones
4,258,522 A * 3/1981 Amaral ..... 52/591.2
4,269,013 A * 5/1981 West ..... 52/405.1
4,344,263 A * 8/1982 Farmont ..... 52/233
4,348,845 A * 9/1982 Iannarelli ..... 52/405.3
4,380,887 A * 4/1983 Lee ..... 52/405.1
4,551,959 A 11/1985 Schmid
4,631,885 A * 12/1986 Iannarelli ..... 52/405.2
4,748,782 A * 6/1988 Johnson et al. ..... 52/405.4
4,769,964 A * 9/1988 Johnson et al. ..... 52/405.4
4,856,248 A 8/1989 Larson
4,986,049 A 1/1991 Kennedy
5,024,035 A * 6/1991 Hanson et al. ..... 52/591.1
5,066,440 A 11/1991 Kennedy
5,339,592 A * 8/1994 Schmid ..... 52/606
5,457,926 A * 10/1995 Jensen ..... 52/604
6,494,119 B1 * 12/2002 Coonrad ..... 81/20
6,513,293 B2 * 2/2003 Miller ..... 52/405.1
6,591,569 B2 * 7/2003 Azar ..... 52/604

* cited by examiner

*Primary Examiner*—Richard E Chilcot, Jr.
*Assistant Examiner*—James Ference
(74) *Attorney, Agent, or Firm*—Kloss, Stenger & LoTempio; Vincent G. LoTempio; Douglas R. Smith

(57) ABSTRACT

An insulated building block having a three-section configuration wherein a first cementitious segment containing the internal core hole of the block is interlocked with second cementitious segment by a serpentine configured insulated insert. The insulation insert is operatively arranged to have multiple lips that mate with various indented ledges on each of the other segments in a location proximate to the surface of the cementitious segments. The insulating insert is also configured with wedge holes that accommodate wedges which press into the installation to maintain continuity of the block. The insulation insert has groves that in combination with the other segments form a trough in fluid communication with weep holes which extend through the insulation insert which allows for condensation and seepage of water to drain from the block.

7 Claims, 4 Drawing Sheets

INSULATED BUILDING BLOCK

BACKGROUND OF THE INVENTION

This invention relates to a building block and, more particularly, to an insulating building block.

There are several types of insulating cementitious building blocks used in the building industry. The building blocks are economical, durable and readily available. These and other attributes make concrete building blocks an attractive choice for builders. There are problems however in using and manufacturing the insulated concrete building blocks. To create an insulated building block it is necessary that the insulation is surrounded by concrete. An insulation insert is ordinarily pressed into the center of the concrete block. After production and during transportation of the insulated block the insulation insert is often displaced from within the block and upon delivery it is not positioned flush to the surface of the block thus making it difficult for the mason to stack the block. In addition, the blocks are customarily 12 in. in width having two grout holes and therefore are heavy and cumbersome and when stacking a wall it is necessary to lift a block with two grout holes over the top of re-bars.

Many prior attempts have been made to alleviate the problems associated with insulating building blocks for example, in U.S. Pat. No. 4,185,434 (Jones) the building block is formed from two block parts, one including the front wall of the block and one including the rear wall of the block. These two parts are maintained spaced apart by a layer of insulating material. There are internal "A" and smaller end cavities "B" in Jones' invention that are positioned so that when a plurality of blocks are placed in juxtaposition with each other to form a wall, the overall dimensions of adjacent cavities B are about the same as the dimensions of the cavities A. The cavities, corners and sections 4 and 5 all have squared or linear configurations which could cause the easy fracturing of the cementitious block when a strain is exerted thereon. Also, Jones' block does not have the appearance or feel of a conventional block and could present an unaccustomed structure for the mason to work with. In addition, main sections 4 and 5 are approximately the same size which could prevent obtaining maximum insulation properties.

In Schmid, U.S. Pat. No. 4,551,959, an insulating building block is described having two spaced supportive parts separated from one another by an insulating material. The block of Schmid is substantially solid with no griping holes or means for the mason or builder to work with when lifting and placing the block in position.

In U.S. Pat. No. 4,856,248 (Larson) a building element or block is described having linear sections of varied densities. All sections of Larson are squared or have a linear configuration which could cause easy fracturing of portions of the block. Also, there are no core holes in Larson's structure which would make it difficult for the mason to lift or place the blocks in position. Also, the sections of Larson identified by walls 80-82 and 90-92 are approximately the same size which does not provide maximum insulating properties of the block or building element.

In U.S. Pat. Nos. 4,986,049 and 5,066,440 (Kennedy et al) an improved building block is described having main sections 12 and 14 interlocked by T-shaped structures 34 and 36. Main sections 12 and 14 are approximately equal in size and do not provide any griping holes therein. Insulating portion 16 has thumb holes 154 which are intended to facilitate lifting of the blocks. Conventional cement masonry blocks have substantially large griping holes which workers are accustomed to using. In addition the insulating insert does not have sufficient structure to keep it from being pushed through the concrete block.

In U.S. Pat. No. 5,321,926 (Kennedy et al) an improved building block is described with conventional large core holes, in addition to facilitating lifting, the holes also provide convenient conduits for accommodating wiring and providing an opening or openings for re-bars that are used to reinforce walls. However, the presence of two large core grout holes is a structural drawback because it can only be manufactured as a 12 in. conventional block, due to industry specifications and manufacturing limitations. In addition, when a mason builds a wall with a building block with two core grout holes the mason must lift every block over the re-bar during construction of the wall. This is a tiresome and difficult task.

Thus it is readily apparent that there is a long felt need for an insulated building block which has a single core hole to allow alternating installation over re-bar which can be manufactured as 8, 10 or 12 in. width building block. Also there is a need for an insulated building block with an insulating insert operatively arranged to maintain position within the block after manufacture and during transportation. There is also a long felt need for insulating insert having wedge holes in the insulation to accommodate wedges to maintain continuity of the insulation and an extended lip in the insulation insert that mates with an interior ledge of the concrete block.

SUMMARY OF THE INVENTION

It is a general object of the present invention to provide a building block devoid of the above-noted disadvantages.

Another object of this invention is to provide an insulated building block with an insulation insert that mates with an interior ledge of the concrete block so that the concert remains flush to the concrete block during transportation and prior to stacking.

A further object of this invention is to provide an insulated building block in which the insulation and cement portions of the block will maintain continuity during transportation.

And still further object of this invention is to provide a building block having. wedge holes in the insulation to accommodate wedges to maintain continuity of the insulation and cement portions of the block.

Another object of this invention is to provide an insulating building block that is more structurally stable, it is stronger, easier to handle and has the one-hole configuration and is smaller than conventional blocks.

Another object of this invention is to provide one-core, plain-end units so that placement of reinforcing bars and grout are more easily aligned than conventional blocks because their cores form continuous, vertical spaces in which to place reinforcing bars.

Yet a further object of this invention is to provide a one hole configuration that allows it to be threaded around re-bar for every other course of blocks.

Another object of this invention is to provide a lightweight easy to handle concrete building block.

These and other objects of the present invention are provided by a novel insulating building block having a three-section configuration. Two segments are made of a cementitious material and can have any number of finishes and are load bearing. The first segment is interlocked with second segment by a serpentine configured insulated insert made of any suitable insulating material such as expanded polystyrene (EPS) or the like. The first segment is made of a cementitious material and contains the internal core hole of the block. The first segment is made to interlock with the other two parts of the unit, the insulation insert and the second segment. The suitable insulating material is formed as a solid insert. The installation insert is operatively arranged to have a lip that mates with various indented ledges in a location proximate to the void between the two segments and just below the top surface of each concrete segment. The result of the mating of the ledge and the lip is that the insert cannot be pushed through the void between the first and second segments of the cement block. The insulating insert is also configured with wedge holes in the insulation that accommodate wedges that when pressed into the installation maintains continuity of the insulation. The present invention also provides a building block with weep holes which extend through the insulation insert which allows for condensation and seepage of water to drain within the block.

DESCRIPTION OF A DRAWINGS AND PREFERRED EMBODIMENTS

Figure 1:
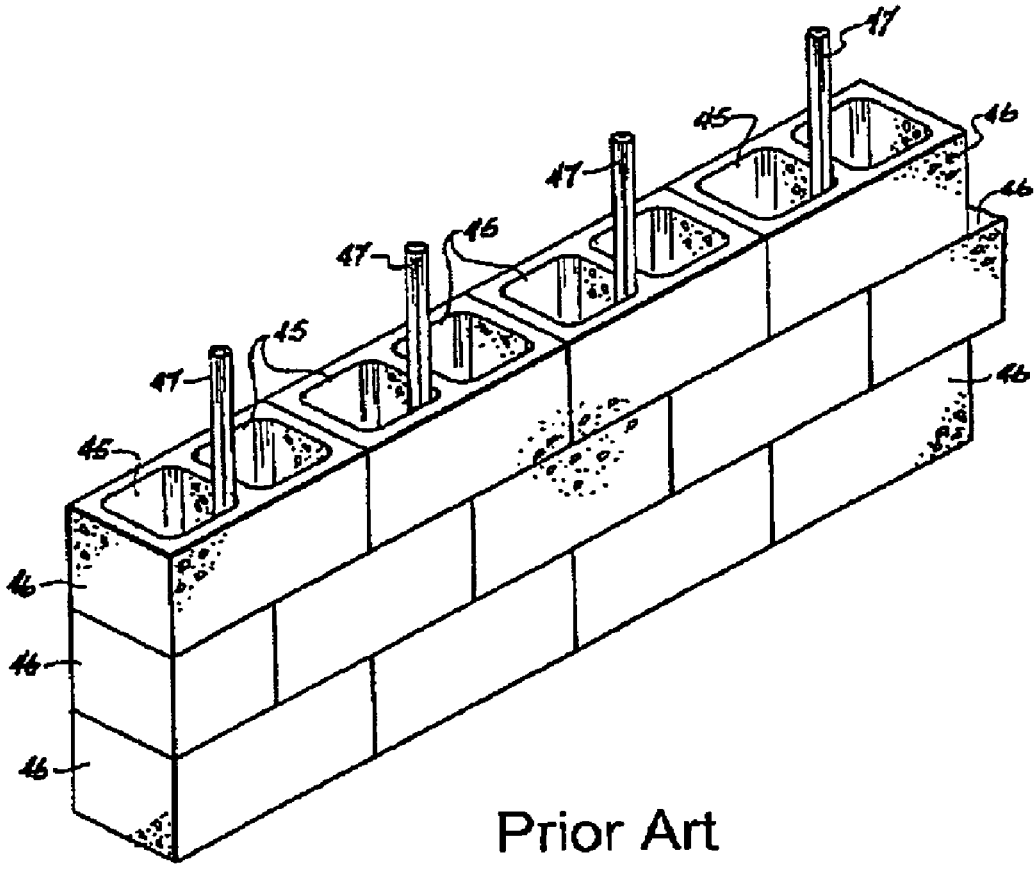
Prior Art FIG. 1
FIG. 1 depicts the known procedure of reinforcing masonry walls and resulting structure by using what is known as re-bar.

At the outset, it should be clearly understood that like reference numerals are intended to identify the same structural elements, portions, or surfaces consistently throughout the several drawing figures, as may be further described or explained by the entire written specification of which this detailed description is an integral part. The drawings are intended to be read together with the specification and are to be construed as a portion of the entire "written description" of this invention as required by 35 U.S.C. §112.

The insulated concrete building block of this invention is best described as a three-segment unit. Two segments are made of a cementitious material and can have any number of finishes and are load bearing. The first segment is interlocked with second segment by a serpentine configured insulated insert made of any suitable insulating material such as expanded polystyrene (EPS) or the like. The first segment is made of a cementitious material and contains the internal core hole of the block and is made to interlock with the other two parts of the unit; the insulation insert and the second segment. The suitable insulating material is preferably made of expanded polystyrene which in production is formed as a solid insert and is positioned into the void between the first and second concrete segment. The installation insert is operatively arranged to have a lip that mates with various indented ledges in a location proximate to the void between the two segments and just below the top surface of each concrete segment. The result of the mating of the ledge and the lip is that the insert cannot be pushed through the void between the first and second segments of the cement block. The insulating insert is also configured with wedge holes. Wedges are pressed into the installation to maintain the continuity of the block. As a result of the lip and wedge combination the insulation insert is maintained in position within the block after manufacture and during transportation. The present invention also provides a building block with weep holes which extend through the insulation insert. Weep holes are a conduit for water to drain within the block.

The insulated block of the present invention is similar in design to that of a conventional building block made of various aggregates to achieve strength, lightness or both however the present invention has a single core hole to allow alternating installation over re-bar which can be manufactured as either as 8, 10 or 12 in. width building block. The individual core hole in the inner part of this insulated block can accommodate the mason or builder and enable this insulated building block to be handled and used in the same manner as conventional building blocks. However the present invention also provides an insulating block with a single core hole that alternately aligns in a convenient arrangement for positioning re-bar around the core hole formed by the end portion of the block. Re-Bar is a term used to define reinforced masonry wall construction. The procedures used in laying masonry units involve placing reinforcing bars and positioning the concrete block so re-bar extends up through the center core hole.

The present invention has only one conventional type core hole in the block; the type of core hole skilled masons are accustomed to and can use comfortably. The end portions of the block are constructed such that they will form a core hole when aligned with another block capable of accepting grout and re-bar. In addition each insulated block should mesh with conventional block when used therewith. It is also a feature of the present invention that the core hole is positioned in the internal center segment of the block and has a large enough circumference to accommodate re-bar and grout. This internal center segment core hole provides grip or hold for easier use. An insulating block with standard sized core hole capable of accepting grout and re-bar can be manufactured in either as 8, 10 or 12 in. width building block. The present invention provides an insulating block with a single core hole that alternately aligns in a convenient arrangement for positioning re-bar around the core hole formed by the end portion of the block.

Hollow concrete masonry units with core holes should be laid so that their alignment of core holes form an unobstructed, continuous series of vertical cores within the wall framework. Vertical reinforcement may be erected before or after the masonry units are laid. When the reinforcing bars (re-bars) are placed before the units, the use of one-core or grip hole opened, A- or H-shaped units become desirable in order for the units to be threaded around the reinforcing steel rather then lifting and threading the block over the top of the re-bar. Both vertical and horizontal reinforcement should be accurately positioned and rigidly secured at intervals by wire ties or spacing devices. The distance between reinforcement and the masonry unit or formed surface must not be less than ¼ inch for fine grout or ½ inch for coarse grout.

For this procedure of reinforcement to be utilized, alternating aligned core holes in each block are required. Prior art blocks without core holes or with two core holes make it extremely difficult to reinforce the walls by re-bar. The design of the present invention makes it much easier for the builder to place the blocks around the re-bar and align the wall using alignment pegs while maintaining the uninterrupted core of insulation. The whole idea of an insulated building block is to combine insulation with high mass so that once the inner mass is heated or cooled it maintains its desired temperature for a longer period of time. This is Insulated Thermal Mass and is the most energy efficient way of maintaining a desired temperature. The temperature-retaining properties of a material are also referred to as Thermal Lag. This characteristic (Thermal Lag) of high mass materials aids the temperature control equipment of a building to maintain the desired state more easily thus using less energy.

Adverting now to the drawings, FIG. 1 depicts the known procedure of reinforcing masonry walls and resulting structure by using what is known as re-bar is illustrated. The importance of having holes 45 in masonry block is clearly shown in this figure. The conventional block 46 is reinforced by the use of steel rods 47 (re-bar) which are extended down through the aligned double core holes 45 in each block. Prior art insulated blocks with two core grout holes 45 make it extremely difficult to construct a reinforced wall because each block has picked up and threaded over the reinforcing bars 47. The present invention provides blocks with both desirable insulation properties and a single core grout hole that allows the block to be threaded around rather than over the re-bar, so that reinforcing bars may be easily used to build a structurally sound, strong wall.

Figure 2:
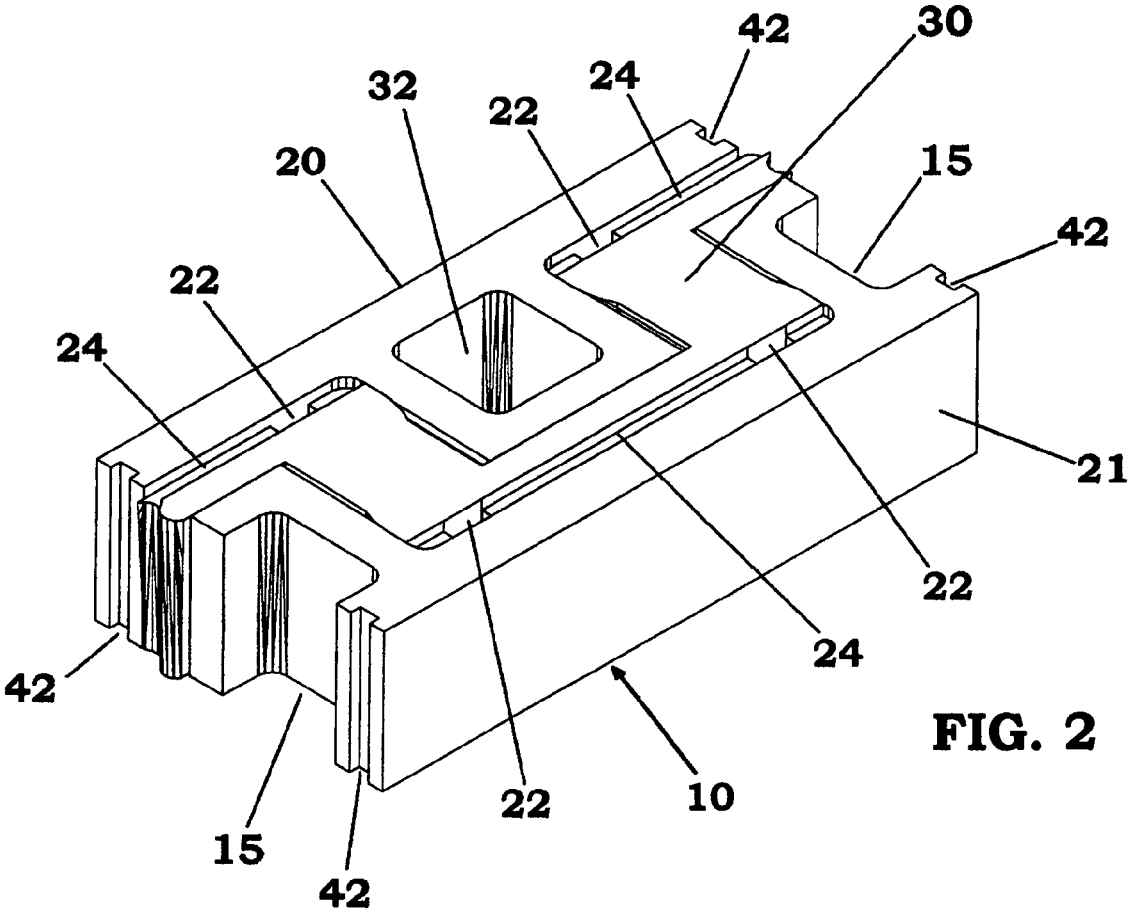
FIG. 2 is a top perspective view of a three-part building block structure of this invention.

FIG. 2 is a top perspective view of a substantially rectangular insulated building block 10 comprising a three-segment structure, a first segment 20 and second segment 21 comprising a cementitious material and insulation insert 30. Insulation insert 30 fills the space between the first segment of block and the second segment of the block and acts as the insulation means for this block structure and also holds segments 21 and 20 together. Insulation insert 30 is made any one of a variety of materials. These include but are not limited to expanded polyethelene, polyurethane resins, polystyrene resins, phenolic resins, formaldehyde resins and mixtures thereof. Heavy fire resistant foams and lead-lined materials for R.F. wave blocking or other suitable materials may also be used.

An important feature of this invention is to provide an insulating building block having a single core hole 32. Masons and other builders are used to handling cement blocks with two core holes 32 rather than solid or thumb holes or other openings suggested by the prior art. In addition, the block 10 of this invention provides core holes 32 that are easily reinforced with re-bar and can better accommodate wiring and other items which require through conduits. C-shaped sides 15 permit the re-bars (not shown) to be used between the sides of the blocks. When a mason is laying the blocks adjacent to each other to form a wall, the concrete blocks are laid so that their alignment of core holes form an unobstructed, continuous series of vertical cores within the wall framework. As blocks are placed next to each other the C-shaped sides 15 form an additional core hole. As a result of placing the blocks side-by-side the mason does not have to lift insulated building block 10 above the bars, but slide the block around the bar for alternating courses of block. However, it is preferable to stack each block on the top of an existing course of block so that center core hole 32 is aligned with the core holes formed by C-shaped sides 15. Therefore for each alternating course, in order to form a continuous series of vertical cores within the wall framework, it will be necessary to lift the block over-the-top of each re-bar. As a result the mason will only have to lift half the blocks over the Rebar.

Also, it is highly preferred to provide the side portions of block 10 with mortar grooves 42 for improved adhesion to adjacent blocks in the wall structure. In addition the both side portions 15 of bottom segment 21 are C-shaped. When block 10 of this invention, is placed adjacent to another block it forms a core hole which is threaded around the re-bar during stacking as alternating core holes are formed.

The in-plant production of the block of this invention is not any more labor intensive than production of other insulated blocks. This unit will provide great design variety for the outside facade. For aesthetic purposes, the facade can be produced with any number of finishes, e.g. splitface, split fluted, scored, glazed, ground or burnished. This block will easily combine with post-tensioning systems which are extensively used in Europe and are rapidly becoming accepted as a technique of building reinforcing in the United States.

The cementitious first and second segments of this block can be made with several different aggregates from heavy dense cement and stone to lightweight expanded shale and pumice depending on the design requirements of a particular structure. Any of the known insulating building block manufacturing processes can be used in the present invention such as those disclosed in U.S. Pat. No. 4,986,049. Any suitable insulation material may be used such as those defined in U.S. Pat. Nos. 4,185,434; 4,551,959; 4,856,248 and 4,986,049. Preferably, the block of the present invention is made by the procedure described in U.S. Pat. Nos. 5,066,440 and 5,321,926.

Figure 3:
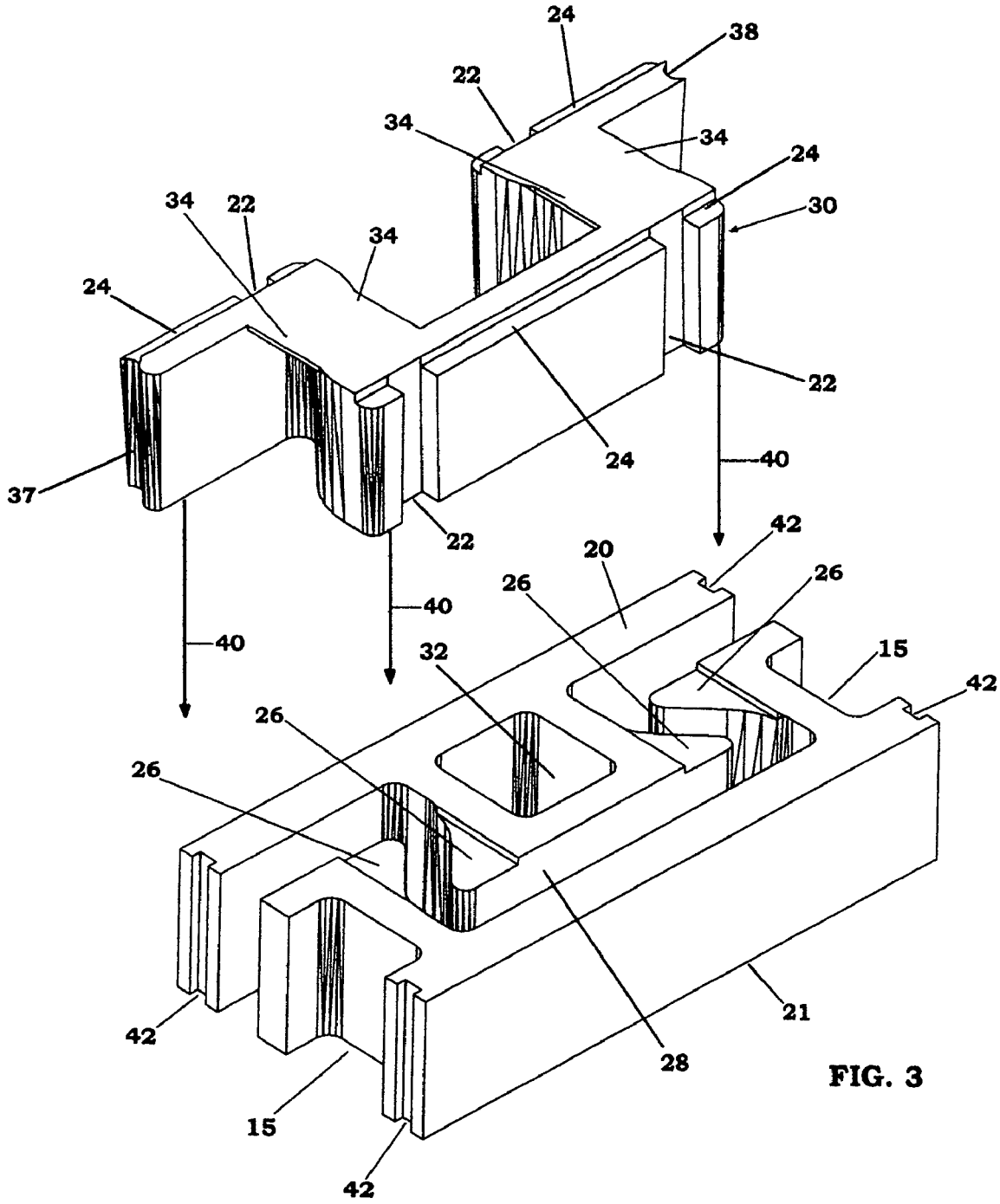
FIG. 3 is an exploded view of the present invention.

FIG. 3 is an exploded plan view of the preferred embodiment of the present invention wherein insulated the building block comprises a first segment 20 with a generally square shaped core hole 32 and a second segment 21 each with extensions 26 forming a dovetail-like projection for interlocking the entire unit. First segment 20 and second segment 21 are arranged with their interior surfaces facing each other in a spaced relationship, leaving the desired space into which the insulation insert 30 will be deposited, sprayed or otherwise positioned. First segment 20 and second segment 21 are arranged to create a central serpentine receiving opening 28 which receives insulation insert 30 and locks the block together. Insulation insert 30 is made of an insulation material generally contoured to the shape of the serpentine shaped receiving opening 28. The insulation insert 30 is positioned within segments 20 and 21 and all three parts are adhered together thereby.

Insulation insert 30 is pressed in the general direction of arrows 40 between first segment 20 and second segment 21 which are arranged to receive the insulation insert. Extensions 26 are dovetail shaped extensions of the concrete segments of the block which forms a concave-convex serpentine space between the concrete segments and is operatively arranged with a depressed ledge proximate to the top surface of the block. The ledge of extension 26 is configured as the resting place for lips 34 of the insulated insert. Lips 34 extend outwardly from the general body of the insulation insert so that the entire insert cannot pass entirely through receiving opening 28. As a result of the depressed ledge, once the insert is positioned within the space between the segments lip 34 rests on the top of extensions 26 and the top surface of insulation insert 30 remains flush with the top surface the block. This is important to hold insulated insert 30 so that it can not fall away or be dislodged or pushed through receiving opening 28. It will be noted that a properly positioned insulation insert will rest between the concrete segments so that the combined top surface of the block and insulation insert is flat and even and thus conducive for stacking. The lips allow for a greater amount of insulation to be used than would a straight line insulation portion. In addition the insert is configured with convex end 37 that is outwardly curved so as to align and couple with an opposing concave end 38. The ends of insulation insert 30 are positioned so as to mate when blocks are aligned to form a wall. This convex-concave compatible shape aids in the alignment of the wall and improves the overall strength and integrity of each block connection.

FIG. 3 also depicts weep holes 22 on the insert and C-shaped sides 15 of second segment 21. C-shaped sides 15 are approximately one half the size of grout hole 32 and when laid adjacent to another block the sides form an additional core hole. In the preferred embodiment using the block to form a wall the blocks are aligned so that the grout hole formed by the sides of the block alternately aligns with an existing grout hole 32. The stacked blocks form continuous cavities within the wall where grout holes and the weep holes align. As a result of the continuous cavity formed by the core holes grout can be poured down through each block the entire length of the wall. Also, it is highly preferred to provide the end of segments 20 and 21 with mortar grooves 42 so that when a course of blocks are stacked to form a wall and each block is aligned next to each other, there is improved adhesion to adjacent blocks in the wall structure.

The insulation insert of the instant invention is also configured with a vertical positioned rectangular channel that together with the concrete segments forms weep holes 22. The weep holes extend longitudinally through a portion of the insert that contacts outside segment 21. The exterior of a concrete wall will sometimes be subjected to the harsh impact of the environment. Quite often moisture or water seeps into a block because of wind and rain conditions and accumulates within the structure of the block. If water is not removed it can affect the integrity of the structure as well as become a breeding place for bacteria and mold. Insulation insert 30 is placed between the concrete segments and groove 24 forms a channel or trough which allows the water to accumulate and drain into weep holes 22. As a result of the continuous cavity formed by the weep holes water is allowed to seep down through each block the entire length of the wall.

Figures 4, 4A, 4B:
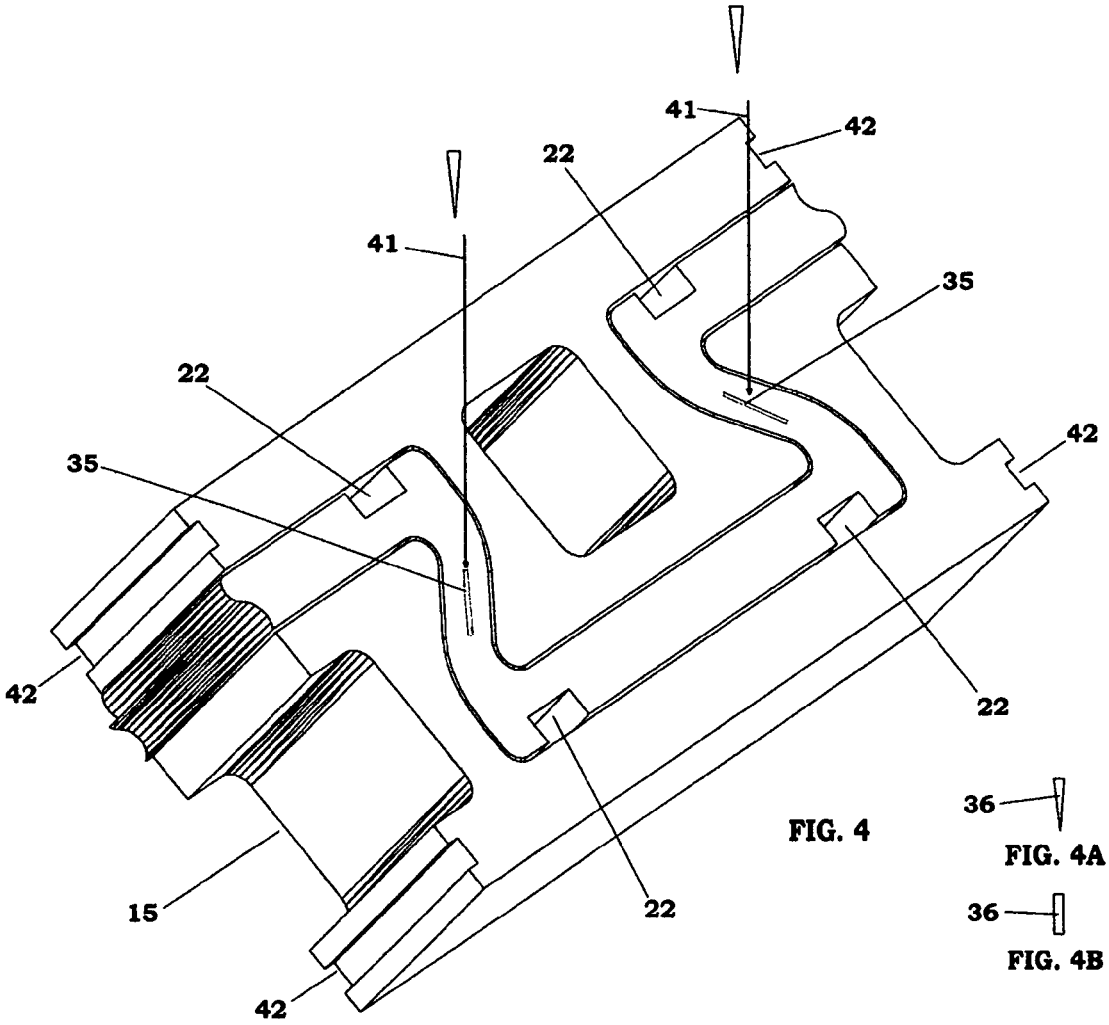
FIG. 4 is a bottom perspective view of a three-part building block structure of this invention.
FIGS. 4A and 4B are perspective views of the wedge embodiments of the present invention.

FIG. 4 is a bottom perspective view of the cementitious segments joined with an insulation insert provided with wedge holes 35. It is not uncommon for insulated concrete block 10 to be moved before use where stresses are exerted upon it and as a result the insert has a tendency to be displaced or to "loosen up" upon the application of stresses thereon. Another significant feature of this invention is the inclusion of wedge holes 35 in the insulation portion of insulated concrete building block 10. The wedge holes are configured to accommodate wedge 36 (a small wedge or shim). As seen in FIGS. 4A and 4B wedge 36 is a substantially rectangular or triangularly shaped wedge. The wedge is driven into the center of the insulation in the general direction of arrows 41 to securely position and wedge the insulation between the cement portions of the block. As a result of the position of the wedge the insulation will maintain continuity with the cement segments of the block despite the application of any external stress. The preferred placement of the wedge within the insulation insert is halfway between the top and the bottom of the block and about one quarter of the distance from the end of the block. This position allows it to maintain pressure in equal amounts in both the inner in the outer portions of the insulation. There are other locations that the wedge may be placed in the insulation portion of block to accomplish the same function, including but not limited to the side of the block (not shown in the drawings). As a result of the lip and wedge combination the insulation insert maintains position within the block after manufacture and during transportation.

The preferred embodiment of the present invention is a vast improvement on existing structures used as insulating building blocks. The advantages of the insulating block of the present invention are: it is more structurally stable, it is stronger, easier to handle (preferably has the one-hole configuration and thus is smaller than conventional blocks), it is more easily reinforced with re-bar (the one hole configuration allows it to be threaded around the re-bar for every other course of blocks), it can easily accommodate wiring, conduit and additional concrete or insulating fill in these holes. It has an insulation insert that is configured to maintain position through production, transportation and stacking on the construction site.

The preferred embodiments of the present invention have been described herein and shown in the accompanying drawings to illustrate the underlying principles of the invention but it is to be understood that numerous modifications and ramifications may be made without departing from the spirit and scope of this invention.

What is claimed is:

1. A substantially rectangular building block comprising:

a first segment made of a cementitious material having a core hole; a separate second segment made of a cementitious material engaging said first segment to create a central serpentine receiving opening; an insulation insert generally contoured to the shape of said serpentine shaped receiving opening and positioned in said receiving opening; at least one dovetail projection extending inwardly from each first segment and at least one receiving opening in each second segment receiving said projection and connecting said first and second segments with said insulation insert therebetween; and a means for maintaining said insulation insert in said receiving opening being at least one of said dovetail projections having a depressed ledge substantially parallel to an upper surface positioned on said inwardly extending projection and on said receiving opening proximate to the upper surface of the interior of the block as a resting place receiving a planar lip extension of said insulated insert.

2. The building block of claim 1 wherein said means for maintaining the insulation insert in said receiving opening is at least one slot provided in a bottom section of said insulation insert to accommodate a wedge.

3. The building block of claim 1 having adjacent terminal portions wherein said insulating insert extends beyond said adjacent terminal portions of said first segment and said second segment in a concave-convex relationship.

4. The building block of claim 1 wherein said terminal ends of said building block are shaped to form one half of a core hole.

5. The building block of claim 3 wherein at least two mortar grooves are positioned on terminal ends of said building block.

6. The building block of claim 1 wherein said projection extends substantially beyond said entrance of said receiving opening and interlocks therewith.

7. The building block of claim 1 wherein said insulating insert is configured with a least one vertical through that acts as a fluid conduit that is in communication with at least one weep hole.

* * * * *